US011815276B2

(12) United States Patent
Gao et al.

(10) Patent No.: US 11,815,276 B2
(45) Date of Patent: Nov. 14, 2023

(54) AIR CONDITIONER CONTROL METHOD AND DEVICE, AND COMPUTER STORAGE MEDIUM

(71) Applicants: QINGDAO HAIER AIR-CONDITIONING ELECTRONIC CO., LTD., Shandong (CN); HAIER SMART HOME CO., LTD., Shandong (CN)

(72) Inventors: Yuhui Gao, Shandong (CN); Shaojiang Cheng, Shandong (CN); Baitian Zhuo, Shandong (CN); Jun Wang, Shandong (CN); Benhai Yuan, Shandong (CN); Bin Shi, Shandong (CN)

(73) Assignees: QINGDAO HAIER AIR-CONDITIONING ELECTRONIC CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 317 days.

(21) Appl. No.: 17/297,633

(22) PCT Filed: Jan. 10, 2020

(86) PCT No.: PCT/CN2020/071468
§ 371 (c)(1),
(2) Date: May 27, 2021

(87) PCT Pub. No.: WO2020/143778
PCT Pub. Date: Jul. 16, 2020

(65) Prior Publication Data

US 2022/0042711 A1 Feb. 10, 2022

(30) Foreign Application Priority Data

Jan. 10, 2019 (CN) ..... 2019100238953.4

(51) Int. Cl.
*F24F 11/66* (2018.01)
*F24F 11/80* (2018.01)
(Continued)

(52) U.S. Cl.
CPC ..... *F24F 11/66* (2018.01); *F24F 11/80* (2018.01); *F24F 2120/00* (2018.01); *F24F 2140/60* (2018.01)

(58) Field of Classification Search
CPC ..... F24F 11/66; F24F 11/80; F24F 2120/00; F24F 2140/60; F24F 2120/14
See application file for complete search history.

(56) References Cited

U.S. PATENT DOCUMENTS 6,290,140 B1 * 9/2001 Pesko ..... H04K 3/45 236/47
2013/0085614 A1 4/2013 Wenzel
(Continued)

FOREIGN PATENT DOCUMENTS

CN 105091217 11/2015
CN 105222266 1/2016
(Continued)

OTHER PUBLICATIONS

International Search Report and Written Opinion from PCT/CN2020/071468 dated Apr. 10, 2020.
Office action from Chinese Application No. 201910023893.4 dated Dec. 23, 2020.

*Primary Examiner* — Mohammad Ali
*Assistant Examiner* — Vincent W Chang
(74) *Attorney, Agent, or Firm* — Calfee, Halter & Griswold LLP

(57) ABSTRACT

The present invention discloses a method and an apparatus for controlling an air conditioner, and a computer storage medium, and relates to the technical field of intelligent household appliances. The method includes acquiring a
(Continued)

current physical characteristic parameter of an air conditioner user in a current sampling timeframe; and adjusting either or both of a current set temperature and a current compressor frequency of the air conditioner according to the current physical characteristic parameter and current energy consumption of the air conditioner when the current physical characteristic parameter falls within a set range of parameters in sleep. Therefore, energy conservation and a comfortable user experience are compatible, thereby providing more functions for the control of the air conditioner in the sleep mode.

16 Claims, 4 Drawing Sheets

(51) Int. Cl.
*F24F 140/60* (2018.01)
*F24F 120/00* (2018.01)

(56) References Cited

U.S. PATENT DOCUMENTS

| | | | | |
|---|---|---|---|---|
| 2015/0136379 | A1* | 5/2015 | Takeda | F24F 11/46 165/266 |
| 2016/0334124 | A1* | 11/2016 | Hou | A61B 5/4812 |
| 2018/0073760 | A1* | 3/2018 | Smith | F24F 11/30 |
| 2018/0229583 | A1* | 8/2018 | Craig | B60H 1/00778 |
| 2020/0069907 | A1* | 3/2020 | Mirmiran | F24F 11/66 |
| 2020/0121248 | A1* | 4/2020 | Wright | A61M 21/02 |

FOREIGN PATENT DOCUMENTS

| | | |
|---|---|---|
| CN | 105444334 | 3/2016 |
| CN | 105716196 | 6/2016 |
| CN | 106440249 | 2/2017 |
| CN | 106885344 | 6/2017 |
| CN | 108052012 | 5/2018 |
| CN | 109163424 | 1/2019 |
| JP | 2010133692 | 6/2010 |
| JP | 2011036084 | 2/2011 |

* cited by examiner

AIR CONDITIONER CONTROL METHOD AND DEVICE, AND COMPUTER STORAGE MEDIUM

CROSS-REFERENCE TO RELATED APPLICATIONS

The present application is the national stage of PCT Application No. PCT/CN2020/071468, filed on Jan. 10, 2020, which claims priority to the Chinese patent application No. 201910023893.4, filed on Jan. 10, 2019, which are incorporated herein by reference in their entireties.

TECHNICAL FIELD

The invention relates to the technical field of intelligent household appliances, and more particularly, to a method and an apparatus for controlling an air conditioner, and a computer storage medium.

BACKGROUND

As people's living standards have improved, air conditioners have become indispensable to people's daily life. An air conditioner has not only the basic core functions such as refrigerating and heating, but also auxiliary functions such as self-cleaning and a sleep mode. In the sleep mode, a set temperature rises by n1° C. after m1 hours of operation when the air conditioner is refrigerating or dehumidifying and further rises by n2° C. after m2 hours of operation until a temperature limit of refrigerating is reached; the set temperature falls by n3° C. after m3 hours of operation when the air conditioner is heating and further falls by n4° C. after m4 hours until a temperature limit of heating is reached.

Currently, such control is too simple to meet the requirement of the comfort of various users, despite that the power consumption is saved to a certain extent.

SUMMARY

The embodiments of the invention provide a method and an apparatus for controlling an air conditioner, and a computer storage medium. A summary is provided below to facilitate basic understandings of some aspects of the disclosed embodiments. This summary is not a general overview, nor is it intended to identify key/critical elements or to define the scope of the embodiments, rather, it's the sole purpose of the summary to present some concepts in a simplified form as a prelude to the more detailed description that follows.

In a first aspect of the embodiments of the present invention, a method for controlling an air conditioner is provided, including:

acquiring a current physical characteristic parameter of an air conditioner user in a current sampling timeframe; and adjusting either or both of a current set temperature and a current compressor frequency of the air conditioner according to the current physical characteristic parameter and current energy consumption of the air conditioner when the current physical characteristic parameter falls within a set range of parameters in sleep.

In an embodiment of the invention, adjusting either or both of a current set temperature and a current compressor frequency of the air conditioner includes:

determining a current first physical characteristic coefficient and a current first energy consumption coefficient which respectively correspond to the current physical characteristic parameter and the current energy consumption in a selected current sleep control strategy;

determining and storing the current set temperature of the air conditioner according to the current first physical characteristic coefficient, the current first energy consumption coefficient, and Equation (1), and controlling the air conditioner according to the current set temperature;

$$Tc=To-(at*U+ct*W) \quad (1)$$

where Tc is the current set temperature, To is a previous set temperature, U is the current physical characteristic parameter, W is the current energy consumption, and at and ct are the current first physical characteristic coefficient and the current first energy consumption coefficient, respectively.

In an embodiment of the invention, adjusting either or both of a current set temperature and a current compressor frequency of the air conditioner includes:

determining a current second physical characteristic coefficient and a current second energy consumption coefficient corresponding to the current physical characteristic parameter and the current energy consumption in the selected current sleep control strategy when the current physical characteristic parameter falls with a preset range of parameters and a duration longer than a set timeframe has elapsed, wherein the set range of parameters in sleep includes the preset range of parameters;

determining and storing the current compressor frequency of the air conditioner according to the current second physical characteristic coefficient, the current second energy consumption coefficient, and Equation (2), and controlling the air conditioner according to the current compressor frequency;

$$Fc=fo-(ap*Up+cp*W) \quad (2)$$

wherein fc is the current set temperature, fo is the previous set temperature, U is the current physical characteristic parameter, W is the current energy consumption, and ap and cp are the current second physical characteristic coefficient and the current second energy consumption coefficient, respectively.

In an embodiment of the invention, the method further includes:

configuring each sleep control strategy, storing corresponding relations of a range of physical characteristic parameters with the first physical characteristic coefficient and the second physical characteristic coefficient in each sleep control strategy, and storing the corresponding relations of a range of energy consumption with the first energy consumption coefficient and the second energy consumption coefficient in each sleep control strategy;

wherein the sleep control strategy includes a first sleep control strategy or a second sleep control strategy; within a certain physical characteristic range, an absolute value of the first physical characteristic coefficient in the first sleep control strategy is greater than an absolute value of the first physical characteristic coefficient in the second sleep control strategy; within a certain range of energy consumption, an absolute value of the first energy consumption coefficient in the first sleep control strategy is smaller than an absolute value of the first energy consumption coefficient in the second sleep control strategy; within a certain physical characteristic range, an absolute value of the second physical characteristic coefficient in the first sleep control strategy is smaller than an absolute value of the second physical characteristic coefficient in the second sleep control strategy; within a certain range of energy consumption, an absolute value of the second energy consumption coefficient in the first sleep control strategy is greater than an absolute value of the second energy consumption coefficient in the second sleep control strategy.

According to a second aspect of the embodiments of the present invention, an apparatus for controlling an air conditioner is provided, including:

an acquisition unit for acquiring a current physical characteristic parameter of an air conditioner user in a current sampling timeframe; and a control unit for adjusting either or both of a current set temperature and a current compressor frequency of the air conditioner according to the current physical characteristic parameter and current energy consumption of the air conditioner when the current physical characteristic parameter falls within a set range of parameters in sleep.

In an embodiment of the invention, the control unit includes:

a first determination subunit for determining a current first physical characteristic coefficient and a current first energy consumption coefficient which respectively correspond to the current physical characteristic parameter and the current energy consumption in a selected current sleep control strategy;

a first control subunit for determining and storing the current set temperature of the air conditioner according to the current first physical characteristic coefficient, the current first energy consumption coefficient, and Equation (1), and controlling the air conditioner according to the current set temperature;

$$Tc=To-(at*U+ct*W) \quad (1)$$

where Tc is the current set temperature, To is a previous set temperature, U is the current physical characteristic parameter, W is the current energy consumption, and at and ct are the current first physical characteristic coefficient and the current first energy consumption coefficient, respectively.

In an embodiment of the invention, the control unit includes:

a second determination subunit for determining a current second physical characteristic coefficient and a current second energy consumption coefficient corresponding to the current physical characteristic parameter and the current energy consumption in the selected current sleep control strategy when the current physical characteristic parameter falls with a preset range of parameters and a duration longer than a set timeframe has elapsed, wherein the set range of parameters in sleep includes the preset range of parameters;

determining and storing the current compressor frequency of the air conditioner according to the current second physical characteristic coefficient, the current second energy consumption coefficient, and Equation (2), and controlling the air conditioner according to the current compressor frequency;

$$Fc=fo-(ap*Up+cp*W) \quad (2)$$

wherein fc is the current set temperature, fo is the previous set temperature, U is the current physical characteristic parameter, W is the current energy consumption, and ap and cp are the current second physical characteristic coefficient and the current second energy consumption coefficient, respectively.

An embodiment of the invention further includes:

a configuration unit for configuring each sleep control strategy, storing corresponding relations of a range of physical characteristic parameters with the first physical characteristic coefficient and the second physical characteristic coefficient in each sleep control strategy, and storing the corresponding relations of a range of energy consumption with the first energy consumption coefficient and the second energy consumption coefficient in each sleep control strategy; wherein the sleep control strategy includes a first sleep control strategy or a second sleep control strategy; within a certain physical characteristic range, an absolute value of the first physical characteristic coefficient in the first sleep control strategy is greater than an absolute value of the first physical characteristic coefficient in the second sleep control strategy; within a certain range of energy consumption, an absolute value of the first energy consumption coefficient in the first sleep control strategy is smaller than an absolute value of the first energy consumption coefficient in the second sleep control strategy; within a certain physical characteristic range, an absolute value of the second physical characteristic coefficient in the first sleep control strategy is smaller than an absolute value of the second physical characteristic coefficient in the second sleep control strategy; within a certain range of energy consumption, an absolute value of the second energy consumption coefficient in the first sleep control strategy is greater than an absolute value of the second energy consumption coefficient in the second sleep control strategy.

In a third aspect of the embodiments of the present invention, an apparatus for controlling an air conditioner is provided, and the apparatus is used for the air conditioner and includes:

a processor; and a memory for storing processor-executable instructions;

wherein the processor is configured for:

acquiring a current physical characteristic parameter of an air conditioner user in a current sampling timeframe; and adjusting either or both of a current set temperature and a current compressor frequency of the air conditioner according to the current physical characteristic parameter and current energy consumption of the air conditioner when the current physical characteristic parameter falls within a set range of parameters in sleep.

In a fourth aspect of the embodiments of the present invention, a computer-readable storage medium having stored thereon computer instructions is provided, wherein the instructions, when executed by the processor, perform the steps of the above method.

The technical solution provided by the embodiments of the present invention is advantageous in that:

According to the embodiments of the present invention, after the air conditioner user falls asleep, the air conditioner can be controlled according to the physical characteristic parameter of the user and the energy consumption of the air conditioner, that is, the physical characteristic of the user and the energy consumption are both considered, so that energy conservation and a comfortable user experience are compatible, thereby providing more functions for the control of the air conditioner in the sleep mode.

It is to be understood that both the foregoing summary and the following detailed description are exemplary and explanatory only and are not intended to limit the scope of the present invention.

BRIEF DESCRIPTION OF THE DRAWINGS

The accompanying drawings, which are incorporated in and constitute a part of the description, illustrate embodiments consistent with the invention and explain the invention in conjunction with the description.

DETAILED DESCRIPTION

The following description and the accompanying drawings sufficiently illustrate the embodiments of the invention so that those skilled in the art can practice the embodiments. The examples merely represent possible variations. Individual components and functions are optional unless explicitly required otherwise, and the order of operation may vary. Portions and features of some embodiments may be included in or substituted for those of other embodiments. The scope of embodiments of the invention includes the full scope of the claims, and all available equivalents thereof. Embodiments may be referred to herein individually or collectively by the term "invention" merely for convenience and without intending to automatically limit the scope of this application to any single invention or inventive concept if more than one is in fact disclosed. Herein, relational terms, such as first and second, are used solely to distinguish one entity or operation from another entity or operation without requiring or implying any actual such relationship or order between such entities or operations. Moreover, the terms "include", "comprise", or any other variation thereof, are intended to cover a non-exclusive inclusion, such that a process, method, or apparatus that includes a list of elements does not include only those elements but may include other elements not expressly listed. The various embodiments described herein are set forth incrementally, each focusing on differences from the other embodiments, with like parts being referred to with respect to each other. For the structures, products and the like disclosed in the examples, since they correspond to the portions disclosed in the examples, the description is relatively simple, and reference can be made to the description in the method section herein.

An air conditioner has multiple functions, including refrigerating, heating, sleeping, and the like. According to the embodiments of the invention, after an air conditioner user falls asleep, the air conditioner can be controlled according to a physical characteristic parameter of the user and energy consumption of the air conditioner, that is, the physical characteristic of the user and the energy consumption are both considered, so that energy conservation and a comfortable user experience are compatible, thereby providing more functions for the control of the air conditioner in the sleep mode.

Figure 1:
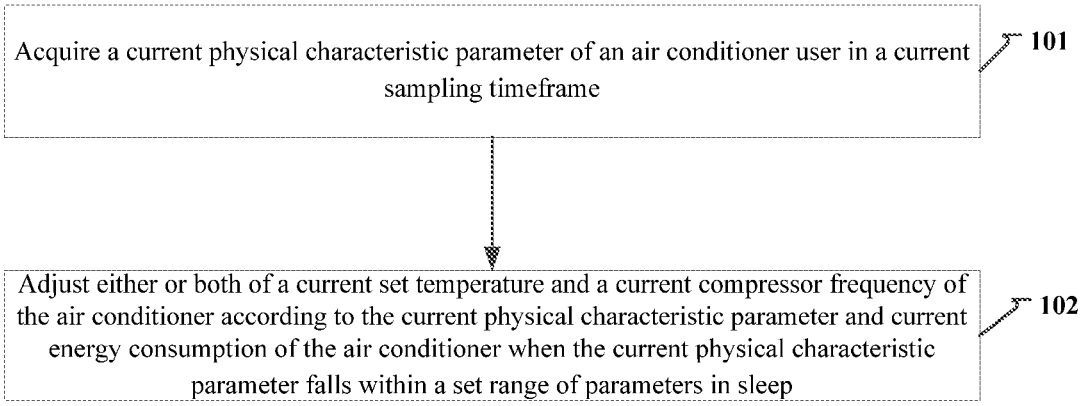
FIG. 1 is a flowchart of a method for controlling an air conditioner according to an exemplary embodiment.

FIG. 1 is a flowchart illustrating a method for controlling an air conditioner according to an exemplary embodiment. As shown in FIG. 1, the process of controlling the air conditioner may include the following steps.

Step 101: a current physical characteristic parameter of an air conditioner user in a current sampling timeframe is acquired.

In this embodiment, a physical characteristic parameter of the air-conditioning user may include either or both of a heart rate and a skin surface temperature. The air conditioner can periodically acquire the physical characteristic parameter of the air conditioner user, for example, by communicating with a wearable device to acquire the heart rate of the user, and by communicating with a wearable device or an infrared temperature measuring device to acquire the skin surface temperature of the air conditioner user and the like. That is, the air conditioner can periodically sample to obtain the corresponding physical characteristic parameter in each sampling timeframe, and for the current sampling timeframe, the current physical characteristic parameter of the air conditioner user in the current sampling timeframe is acquired.

Step 102: either or both of a current set temperature and a current compressor frequency of the air conditioner are adjusted according to the current physical characteristic parameter and current energy consumption of the air conditioner when the current physical characteristic parameter falls within a set range of parameters in sleep.

When sleeping, the user has a lower heart rate and a relatively stable skin surface temperature. A corresponding range of these parameters may be derived from the statistics based on big data, and so far, various wearing devices and monitoring software have been provided with such a corresponding range of parameters. Herein, since different ranges of parameters correspond to different physical characteristic parameters, the set range of parameters in sleep is preconfigured, for example, to include heart rates ranging from 40~75 beats/min and skin surface temperatures ranging from 36~37.3° C. Alternatively, the set range of parameters in sleep has only a corresponding range of heart rates in sleep or a range of skin surface temperatures in sleep.

Therefore, if the current characteristic parameter falls within the set range of parameters in sleep, then it can be determined that the user has fallen asleep, and the control of the air conditioner in the sleep mode can start. For example, the current heart rate is 55 beats/min, and the current skin surface temperature is 36.7° C., which fall within the range of heart rates in sleep, i.e., 40~75 beats/min, and the range of skin surface temperatures in sleep, i.e., 36~37.3° C., respectively, so that it can be determined that the user has fallen asleep, and the control of the air conditioner in the sleep mode can start.

According to this embodiment, the air conditioner can be controlled in consideration of both the physical characteristics of the user and energy consumption, that is, and either or both of the current set temperature and the current compressor frequency of the air conditioner can be adjusted according to the current physical characteristic parameter and the current energy consumption of the air conditioner. Specifically, the current set temperature of the air conditioner can be adjusted according to the current physical characteristic parameter and the current energy consumption of the air conditioner; or the current compressor frequency of the air conditioner can be adjusted according to the current physical characteristic parameter and the current energy consumption of the air conditioner; or the current set temperature and the current compressor frequency of the air conditioner are adjusted according to the current physical characteristic parameter and the current energy consumption of the air conditioner.

Adjusting either or both of the current set temperature and the current compressor frequency of the air conditioner may include adjusting the current set temperature of the air conditioner, and preferably include: determining a current first physical characteristic coefficient and a current first energy consumption coefficient which respectively correspond to the current physical characteristic parameter and the current energy consumption in a selected current sleep control strategy; determining and storing the current set temperature of the air conditioner according to the current first physical characteristic coefficient, the current first energy consumption coefficient, and Equation (1), and controlling the air conditioner according to the current set temperature;

$$Tc=To-(at*U+ct*W) \quad (1)$$

where Tc is the current set temperature, To is a previous set temperature, U is the current physical characteristic parameter, W is the current energy consumption, and at and ct are the current first physical characteristic coefficient and the current first energy consumption coefficient, respectively. Besides, at or ct may be a positive or negative number. For example, at can be negative when the air conditioner is refrigerating and positive when the air conditioner is heating. Alternatively, at may be a negative number when the skin surface temperature is relatively high, and the like.

Adjusting either or both of the current set temperature and the current compressor frequency of the air conditioner may include adjusting the current compressor frequency of the air conditioner, and preferably include: determining a current second physical characteristic coefficient and a current second energy consumption coefficient corresponding to the current physical characteristic parameter and the current energy consumption in the selected current sleep control strategy when the current physical characteristic parameter falls with a preset range of parameters and a duration longer than a set timeframe has elapsed, wherein the set range of parameters in sleep includes the preset range of parameters; determining and storing the current compressor frequency of the air conditioner according to the current second physical characteristic coefficient, the current second energy consumption coefficient, and Equation (2), and controlling the air conditioner according to the current compressor frequency;

$$Fc=fo-(ap*Up+cp*W) \quad (2)$$

wherein fc is the current set temperature, fo is the previous set temperature, U is the current physical characteristic parameter, W is the current energy consumption, and ap and cp are the current second physical characteristic coefficient and the current second energy consumption coefficient, respectively. Likewise, ap or cp may be a positive or negative number, depending on the operation mode of the air conditioner, specific physical characteristic parameters, and the energy consumption.

Since the current set temperature and the current compressor frequency are saved each time the control is performed, the previous set temperature To and the previous compressor frequency fo are available from the saved set temperatures and compressor frequencies.

In this embodiment, surely the current set temperature and the current compressor frequency can be both adjusted, that is, in the selected current sleep control strategy, the current first physical characteristic coefficient and the current first energy consumption coefficient corresponding to the current physical characteristic parameter and the current energy consumption are determined, respectively, and the current second physical characteristic coefficient and the current second energy consumption coefficient corresponding to the current physical characteristic parameter and the current energy consumption are determined, so that the current set temperature of the air conditioner can be determined and stored according to Equation (1), and the air conditioner can be controlled accordingly; after this, the current compressor frequency of the air conditioner is determined and stored according to Equation (2) when the current physical characteristic parameter falls within the preset range of parameters and a duration longer than the set timeframe has elapsed, and then the air conditioner is controlled according to the current set temperature and the current compressor frequency.

Alternatively, when the current physical characteristic parameter falls within the preset range of parameters and a duration longer than the set timeframe has elapsed, the current compressor frequency of the air conditioner is determined and stored according to Equation (2), and the air conditioner is controlled. When the current physical characteristic parameter does not fall within the preset range of parameters, the current set temperature of the air conditioner can be determined and stored according to Equation (1), and then the air conditioner is controlled accordingly.

In this embodiment, different sleep control strategies have to be pre-configured, for example, a first sleep control strategy where the physical characteristics and the comfort feeling of the user are prioritized, or a second sleep control strategy where the energy consumption and energy conservation are prioritized. Besides, in the first sleep control strategy, only the set temperature or both of the set temperature and the compressor frequency of the air conditioner can be adjusted; in the second sleep control strategy, only the compressor of the air conditioner or both of the compressor frequency and the set temperature of the air conditioner can be adjusted. Therefore, in each sleep control strategy, corresponding relations of a range of physical characteristic parameters with the first physical characteristic coefficient and the second physical characteristic coefficient, and corresponding relations of a range of energy consumption with the first energy consumption coefficient and the second energy consumption coefficient are configured, respectively.

In the first sleep control strategy, the physical characteristics and the comfort feeling of the user are prioritized, and in the second sleep control strategy, the energy consumption and energy conservation are prioritized, therefore, within a certain physical characteristic range, an absolute value of the first physical characteristic coefficient in the first sleep control strategy is greater than an absolute value of the first physical characteristic coefficient in the second sleep control strategy; within a certain range of energy consumption, an absolute value of the first energy consumption coefficient in the first sleep control strategy is smaller than an absolute value of the first energy consumption coefficient in the second sleep control strategy; within a certain physical characteristic range, an absolute value of the second physical characteristic coefficient in the first sleep control strategy is smaller than an absolute value of the second physical characteristic coefficient in the second sleep control strategy; within a certain range of energy consumption, an absolute value of the second energy consumption coefficient in the first sleep control strategy is greater than an absolute value of the second energy consumption coefficient in the second sleep control strategy.

Table 1 shows corresponding relations of the range of physical characteristic parameters with the first physical characteristic coefficient and the second physical characteristic coefficient in the first sleep control strategy.

Table 2 shows corresponding relations of the range of physical characteristic parameters with the first physical characteristic coefficient and the second physical characteristic coefficient in the second sleep control strategy.

Table 3 shows corresponding relations of the range of energy consumption with the first energy consumption coefficient and the second energy consumption coefficient in the first sleep control strategy and the second sleep control strategy.

The above-mentioned Tables 1, 2 and 3 are taken as examples, the physical characteristic parameter includes the heart rate and the skin surface temperature, and therefore, in the first sleep control strategy, the first physical characteristic coefficient at includes: a coefficient $a_{1tn}$ corresponding to the heart rate, a coefficient $b_{1ttn}$ corresponding to the skin surface temperature, and a first energy consumption coefficient $c_{1tn}$; while the second physical characteristic coefficient ap includes: a coefficient $a_{1pn}$ corresponding to the heart rate, a coefficient $b_{1pn}$ corresponding to the skin surface temperature, and a second energy consumption coefficient $c_{1pn}$. In the second sleep control strategy, the first physical characteristic coefficients at respectively include: a coefficient $a_{2tn}$ corresponding to the heart rate, a coefficient $b_{2ttn}$ corresponding to the skin surface temperature, and a first energy consumption coefficient $c_{2tn}$, while the second physical characteristic coefficient ap includes: a coefficient $a_{2pn}$ corresponding to the heart rate, a coefficient $b_{2pn}$ corresponding to the skin surface temperature, and a second energy consumption coefficient $c_{2pn}$. Herein, n=1, 2, 3 . . . .

TABLE 3

| First sleep control strategy (comfortable strategy) | | | | |
|---|---|---|---|---|
| | First physical characteristic coefficient at | | Second physical characteristic coefficient ap | |
| Range of physical characteristic parameters | Coefficient corresponding to heart rate in at | Coefficient corresponding to skin surface temperature in at | Coefficient corresponding to heart rate in ap | Coefficient corresponding to skin surface temperature in ap |
| Heart rate lower than 50 | $a_{1t1}$ | | $a_{1p1}$ | |
| Heart rate within 50-60 | $a_{1t2}$ | | $a_{1p2}$ | |
| Heart rate within 60-70 | $a_{1t3}$ | | $a_{1p3}$ | |
| . . . | . . . | | . . . | |
| Skin surface temperature lower than 36 | | $b_{1t1}$ | | $b_{1p1}$ |
| Skin surface temperature within 36-36.5 | | $b_{1t2}$ | | $b_{1p2}$ |
| . . . | | . . . | | . . . |

TABLE 2

| Second sleep control strategy (energy-saving strategy) | | | | |
|---|---|---|---|---|
| | First physical characteristic coefficient at | | Second physical characteristic coefficient ap | |
| Range of physical characteristic parameters | Coefficient corresponding to heart rate in at | Coefficient corresponding to skin surface temperature in at | Coefficient corresponding to heart rate in ap | Coefficient corresponding to skin surface temperature in ap |
| Heart rate lower than 50 | $a_{2t1}$ | | $a_{2p1}$ | |
| Heart rate within 50-60 | $a_{2t2}$ | | $a_{1p2}$ | |
| Heart rate within 60-70 | $a_{2t3}$ | | $a_{2p3}$ | |
| . . . | . . . | | . . . | |
| Skin surface temperature lower than 36 | | $b_{2t1}$ | | $b_{2p1}$ |

TABLE 2-continued

| Second sleep control strategy (energy-saving strategy) | | | | |
|---|---|---|---|---|
| | First physical characteristic coefficient at | | Second physical characteristic coefficient ap | |
| Range of physical characteristic parameters | Coefficient corresponding to heart rate in at | Coefficient corresponding to skin surface temperature in at | Coefficient corresponding to heart rate in ap | Coefficient corresponding to skin surface temperature in ap |
| Skin surface temperature within 36-36.5 | | $b_{2t2}$ | | $b_{2p2}$ |
| . . . | | . . . | | . . . |

TABLE 3

| | First sleep contro strategy | | Second sleep control strategy | |
|---|---|---|---|---|
| Range of energy consumption | First energy consumption coefficient ct | Second energy consumption coefficient cp | First energy consumption coefficient ct | Second energy consumption coefficient cp |
| Energy consumption lower than 0.5 kW | $c_{1t1}$ | $c_{1p1}$ | $c_{2t1}$ | $c_{2p1}$ |
| Energy consumption within 0.5 kW-0.8 kW | $c_{1t2}$ | $c_{1p2}$ | $c_{2t2}$ | $c_{2p2}$ |
| . . . | . . . | | . . . | . . . |

Within a certain range of heart rates, the absolute value of am is greater than $a_{2t1}$, the absolute value of $a_{1t2}$ is greater than $a_{2t2}$, and so on; within a certain range of skin temperatures, the absolute value of $b_{1t1}$ is greater than $b_{2t1}$, the absolute value of $b_{1t2}$ is greater than $b_{2t2}$, and so on; in a certain range of energy consumption, the absolute value of $c_{1t1}$ is smaller than $c_{2t1}$, the absolute value of $c_{1t2}$ is smaller than $c_{2t2}$, and so on.

Within a certain range of heart rates, the absolute value of $a_{1p1}$ is smaller than the absolute value of $a_{2p1}$, the absolute value of $a_{1p2}$ is smaller than the absolute value of $a_{2p2}$, and so on; within a certain range of skin temperatures, the absolute value of $b_{1p1}$ is smaller than the absolute value of $b_{2p1}$, the absolute value of $b_{1p2}$ is smaller than the absolute value of $b_{2p2}$, and so on; within a certain range of energy consumption, the absolute value of $c_{1p1}$ is greater than the absolute value of $c_{2p1}$, the absolute value of $c_{1p2}$ is greater than the absolute value of $c_{2p2}$, and so on.

As can be seen, in the first sleep control strategy, the control of the current set temperature is emphasized, and when the temperature is subjected to the control, the absolute value of the first physical characteristic coefficient corresponding to the physical characteristic parameter is larger, that is, more weight is put on the physical characteristics of the user to provide a comfortable user experience. In the second sleep control strategy, the control of the compressor frequency of the air conditioner is emphasized, and when the frequency is subjected to the control, the absolute value of the energy consumption coefficient corresponding to the energy consumption is larger, that is, more weight is put on the energy consumption to save energy.

As can be seen, according to the embodiments of the invention, after the air conditioner user falls asleep, the air conditioner can be controlled according to the physical characteristic parameter of the user and the energy consumption of the air conditioner, that is, the physical characteristic of the user and the energy consumption are both considered, so that energy conservation and a comfortable user experience are compatible, thereby providing more functions for the control of the air conditioner in the sleep mode.

The flow of the method is integrated into specific embodiments to illustrate the method for controlling provided by the embodiments of the present invention.

In the embodiment, the selected current sleep control strategy can be the first sleep control strategy, in the stored first sleep control strategy, the corresponding relations of the range of physical characteristic parameters with the first physical characteristic coefficient and the second physical characteristic coefficient are shown in Table 1, and in the stored first sleep control strategy, the corresponding relations of the range of energy consumption with the first energy consumption coefficient and the second energy consumption coefficient are shown in Table 3.

Figure 2:
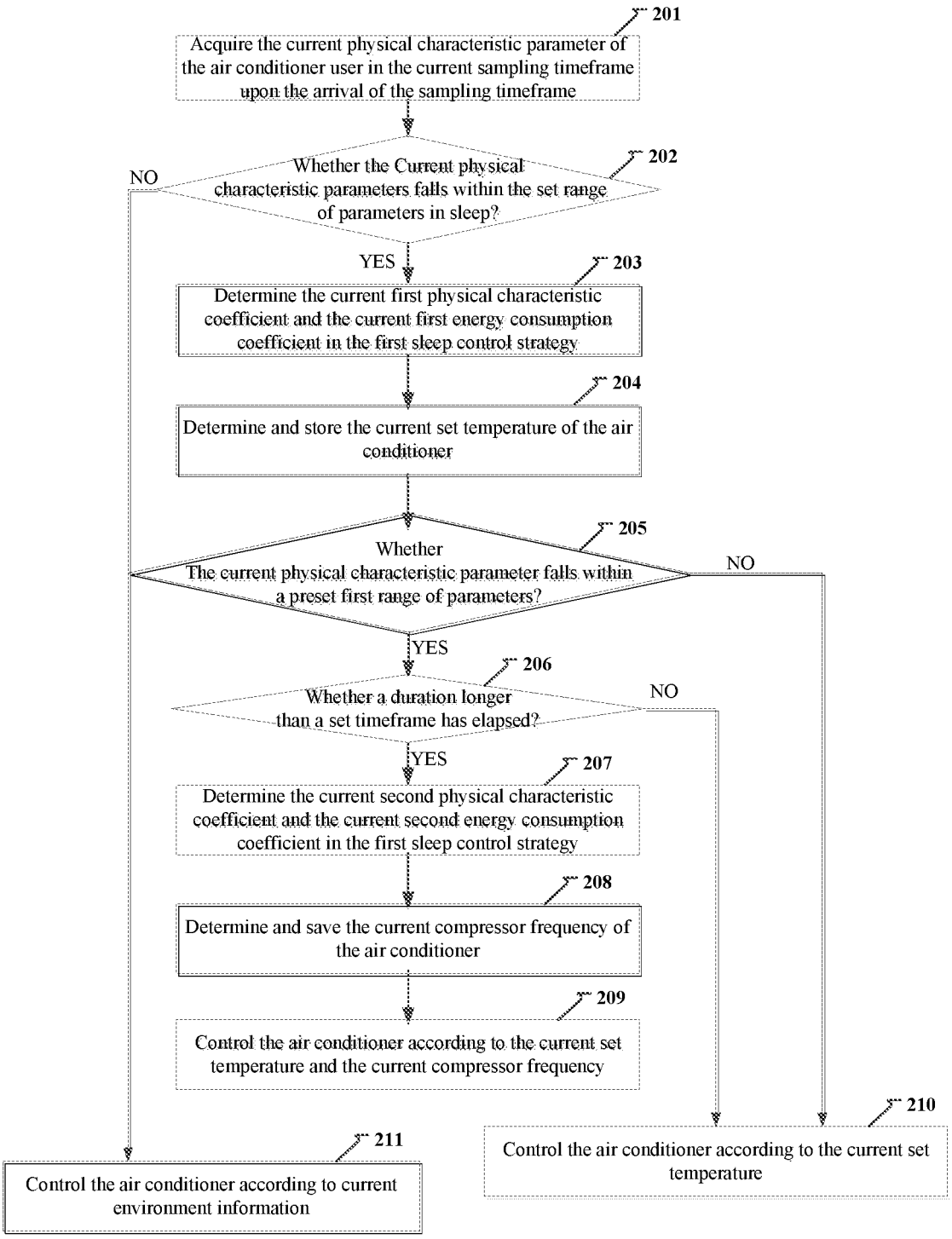
FIG. 2 is a flowchart of the method for controlling an air conditioner according to an exemplary embodiment.

FIG. 2 is a flowchart of the method for controlling an air conditioner according to an exemplary embodiment. As shown in FIG. 2, the process of controlling the air conditioner includes:

step 201: acquiring the current physical characteristic parameter of the air conditioner user in the current sampling timeframe upon the arrival of the sampling timeframe;

step 202: judging whether the current physical characteristic parameter falls within the set range of parameters in sleep, proceeding with step 203 if yes, otherwise, proceeding with step 211;

step 203: determining the current first physical characteristic coefficient and the current first energy consumption coefficient in the first sleep control strategy corresponding to the current physical characteristic parameter and the current energy consumption, respectively;

wherein the current physical characteristic parameter includes the current heart rate and the current skin surface temperature, and thus, as shown in Tables 1 and 3, at may include the coefficient $a_{1m}$ corresponding to the heart rate, and the coefficient $b_{1m}$ corresponding to the skin surface temperature; also, the corresponding first energy consumption coefficient $c_{1m}$ is available, where n=1, 2, 3 . . . ;

step 204: determining and storing the current set temperature of the air conditioner;

wherein the current set temperature of the air conditioner may be determined according to Equation (1); since the current physical characteristic parameter includes the current heart rate and the current skin surface temperature, therefore, preferably, the current set temperature of the air conditioner can be determined according to Equation (3) as follows:

$$Tc=To-(a_{1m}*A+b_{1m}*B+c_{1m}*W) \quad (3)$$

where A is the current heart rate, and B is the current skin surface temperature;

step 205: judging whether the current physical characteristic parameter falls within a preset first range of parameters, proceeding with step 206 if yes, otherwise, proceeding step 210;

wherein the set range of parameters in sleep may be further divided to include the preset first range of parameters, for example, a range of parameters corresponding to deep sleep can be named as the preset first range of parameters;

step 206: judging if a duration longer than the set timeframe has elapsed, proceeding with step 207 if yes, otherwise, proceeding with step 210;

step 207: determining the current second physical characteristic coefficient and the current second energy consumption coefficient in the first sleep control strategy corresponding to the current physical characteristic parameter and the current energy consumption, respectively;

wherein the coefficient $a_{1pn}$ corresponding to the heart rate and the coefficient $b_{1pn}$ corresponding to the skin surface temperature can be obtained from Tables 1 and 3; also, the corresponding first energy consumption coefficient $c_{1pn}$ is available, where n=1, 2, 3 . . . ;

step 208: determining and saving the current compressor frequency of the air conditioner;

wherein the current compressor frequency of the air conditioner can be determined according to Equation (2); since the current physical characteristic parameter includes the current heart rate and the current skin surface temperature, therefore, preferably, the current compressor frequency of the air conditioner can be determined according to Equation (4) as follows:

$$Fc=fo-(a_{1pn}*A+b_{1pn}*B+c_{1pn}*W) \quad (4)$$

where similarly A may be the current heart rate, and B may be the current skin surface temperature;

step 209: controlling the air conditioner according to the current set temperature and the current compressor frequency, and then returning to step 201 for a next round of control of the air conditioner;

step 210: controlling the air conditioner according to the current set temperature, and then returning to step 201 for the next round of control of the air conditioner; and step 211: controlling the air conditioner according to current environment information, that is, the air conditioner does not enter the sleep mode, so that the control of the air conditioner can keep unchanged.

As can be seen, according to this embodiment, in the first sleep control strategy where the physical characteristics and the comfort feeling of the user are prioritized, the air conditioner can be controlled by controlling the set temperature of the air conditioner, and further by controlling the compressor frequency of the air conditioner, as such, when more weight is put on a comfortable user experience, the energy consumption of the air conditioner is also taken into consideration, hence the user experience and energy conservation can be compatible, thereby providing more functions for the control of the air conditioner in the sleep mode.

In another embodiment of the invention, the selected current sleep control strategy can be the second sleep control strategy, in the stored second sleep control strategy, corresponding relations of the range of physical characteristic parameters with the first physical characteristic coefficient and the second physical characteristic coefficient are shown in Table 2, and corresponding relations of the range of energy consumption with the first energy consumption coefficient and the second energy consumption coefficient are shown in Table 3.

Figure 3:
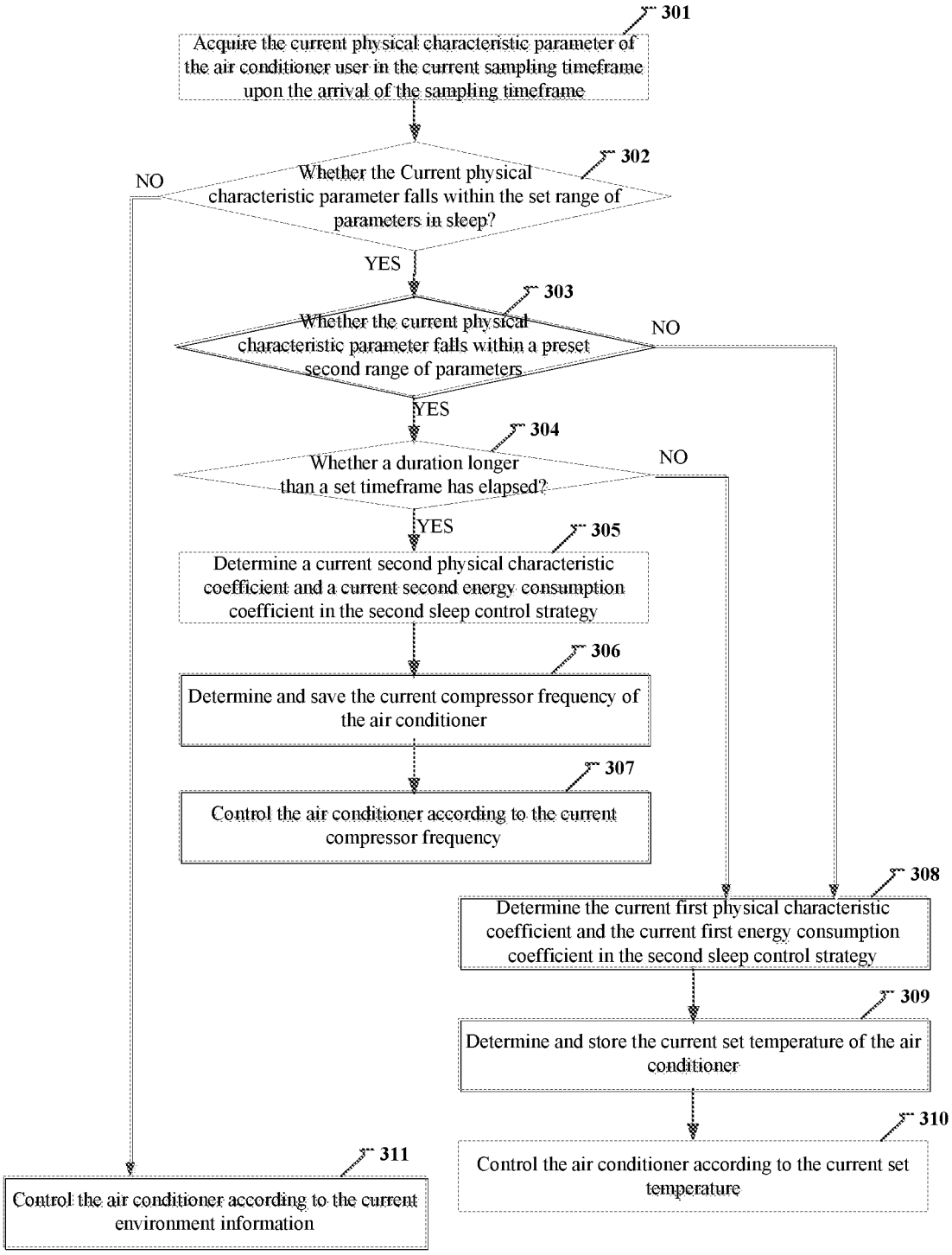
FIG. 3 is a flowchart of the method for controlling an air conditioner according to an exemplary embodiment.

FIG. 3 is a flowchart of the method for controlling an air conditioner according to an exemplary embodiment. As shown in FIG. 3, the process of controlling the air conditioner includes:

step 301: acquiring the current physical characteristic parameter of the air conditioner user in the current sampling timeframe upon the arrival of the sampling timeframe;

step 302: judging whether the current physical characteristic parameter falls within the set range of parameters in sleep, proceeding with step 303 if yes, otherwise, proceeding with step 311;

step 303: judging whether the current physical characteristic parameter falls within a preset second range of parameters, proceeding with step 306 if yes, otherwise, proceeding with step 308;

wherein, the set range of parameters in sleep may be further divided to include the preset second range of parameters; preferably, the preset second range of parameters is larger than the preset first range of parameters in the above embodiment;

step 304: judging if a duration longer than the set timeframe has elapsed, proceeding with step 305 if yes, otherwise, proceeding with step 308;

step 305: determining a current second physical characteristic coefficient and a current second energy consumption coefficient in the second sleep control strategy corresponding to the current physical characteristic parameter and the current energy consumption;

wherein, the coefficient $a_{2pn}$ corresponding to the heart rate and the coefficient $b_{2pn}$ corresponding to the skin surface temperature can be derived from Tables 2 and 3; also, the corresponding first energy consumption coefficient $c_{2pn}$ is available, where n=1, 2, 3 . . . ;

step 306: determining and saving the current compressor frequency of the air conditioner;

wherein, preferably, the current compressor frequency of the air conditioner can be determined according to Equation (5) as follows:

$$Fc=fo-(a_{2pn}*A+b_{2pn}*B+c_{2pn}*W) \quad (5)$$

where similarly, A may be the current heart rate, and B may be the current skin surface temperature;

step 307: controlling the air conditioner according to the current compressor frequency, and then, returning to step 301 for a next round of control of the air conditioner;

step 308: determining the current first physical characteristic coefficient and the current first energy consumption coefficient in the second sleep control strategy corresponding to the current physical characteristic parameter and the current energy consumption, respectively;

wherein the coefficient $a_{2m}$ corresponding to the heart rate and the coefficient ban corresponding to the skin surface temperature can be derived from Tables 2 and 3; also, the corresponding first energy consumption coefficient $c_{2m}$ is available, where n=1, 2, 3 . . . ;

step 309: determining and storing the current set temperature of the air conditioner;

wherein preferably, the current set temperature of the air conditioner can be determined according to Equation (6) as follows:

$$Tc=To-(a_{2m}*A+b_{2m}*B+c_{2m}*W) \quad (6)$$

where A is the current heart rate, and B is the current skin surface temperature;

step 310: controlling the air conditioner according to the current set temperature, and then, returning to step 301 for the next round of control of the air conditioner; and step 311: controlling the air conditioner according to the current environment information, that is, the air conditioner does not enter the sleep mode, so that the control of the air conditioner can keep unchanged.

As can be seen, according to this embodiment, in the second sleep control strategy where the energy consumption of the air conditioner is prioritized, the air conditioner can be controlled by controlling the compressor frequency of the air conditioner, and further by controlling the set temperature of the air conditioner, as such, when more weight is put on energy consumption, a comfortable user experience is also taken into consideration, hence the user experience and energy conservation can be compatible, thereby providing more functions for the control of the air conditioner in the sleep mode.

According to the above process of controlling the air conditioner, an apparatus for controlling the air conditioner can be configured.

Figure 4:
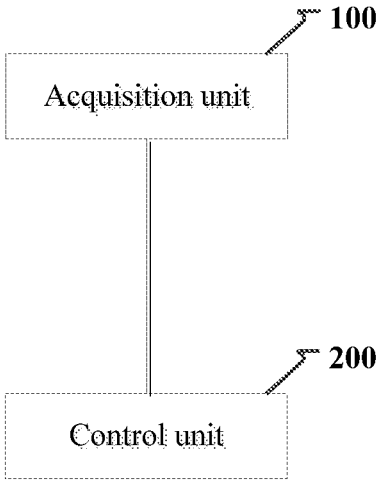
FIG. 4 is a block diagram of an apparatus for controlling an air conditioner according to an exemplary embodiment.

FIG. 4 is a block diagram of an apparatus for controlling an air conditioner according to an exemplary embodiment. As shown in FIG. 4, the apparatus may include an acquisition unit 100 and a control unit 200.

The acquisition unit 100 is configured for acquiring the current physical characteristic parameter of the air conditioner user in the current sampling timeframe.

The control unit 200 is configured for adjusting either or both of the current set temperature and the current compressor frequency of the air conditioner according to the current physical characteristic parameter and the current energy consumption of the air conditioner when the current physical characteristic parameter falls within the set range of parameters in sleep.

In an embodiment of the present invention, the control unit 200 includes:

a first determination subunit for determining a current first physical characteristic coefficient and a current first energy consumption coefficient which respectively correspond to the current physical characteristic parameter and the current energy consumption in a selected current sleep control strategy;

a first control subunit for determining and storing the current set temperature of the air conditioner according to the current first physical characteristic coefficient, the current first energy consumption coefficient, and Equation (1), and controlling the air conditioner according to the current set temperature;

$$Tc=To-(at*U+ct*W) \quad (1)$$

where Tc is the current set temperature, To is a previous set temperature, U is the current physical characteristic parameter, W is the current energy consumption, and at and ct are the current first physical characteristic coefficient and the current first energy consumption coefficient, respectively.

In an embodiment of the present invention, the control unit 200 includes:

a second determination subunit for determining a current second physical characteristic coefficient and a current second energy consumption coefficient corresponding to the current physical characteristic parameter and the current energy consumption in the selected current sleep control strategy when the current physical characteristic parameter falls with a preset range of parameters and a duration longer than a set timeframe has elapsed, wherein the set range of parameters in sleep includes the preset range of parameters;

determining and storing the current compressor frequency of the air conditioner according to the current second physical characteristic coefficient, the current second energy consumption coefficient, and Equation (2), and controlling the air conditioner according to the current compressor frequency;

$$fc=fo-(ap*Up+cp*W) \quad (2)$$

wherein fc is the current set temperature, fo is the previous set temperature, U is the current physical characteristic parameter, W is the current energy consumption, and ap and cp are the current second physical characteristic coefficient and the current second energy consumption coefficient, respectively.

An embodiment of the invention further includes:

a configuration unit for configuring each sleep control strategy, storing corresponding relations of the range of physical characteristic parameters with the first physical characteristic coefficient and the second physical characteristic coefficient in each sleep control strategy, and storing the corresponding relations of the range of energy consumption with the first energy consumption coefficient and the second energy consumption coefficient in each sleep control strategy; wherein the sleep control strategy includes the first sleep control strategy or the second sleep control strategy; within a certain physical characteristic range, an absolute value of the first physical characteristic coefficient in the first sleep control strategy is greater than an absolute value of the first physical characteristic coefficient in the second sleep control strategy; within a certain range of energy consumption, an absolute value of the first energy consumption coefficient in the first sleep control strategy is smaller than an absolute value of the first energy consumption coefficient in the second sleep control strategy; within a certain physical characteristic range, an absolute value of the second physical characteristic coefficient in the first sleep control strategy is smaller than an absolute value of the second physical characteristic coefficient in the second sleep control strategy; within a certain range of energy consumption, an absolute value of the second energy consumption coefficient in the first sleep control strategy is greater than an absolute value of the second energy consumption coefficient in the second sleep control strategy.

The apparatus for controlling the air conditioner will be described in detail below.

Figure 5:
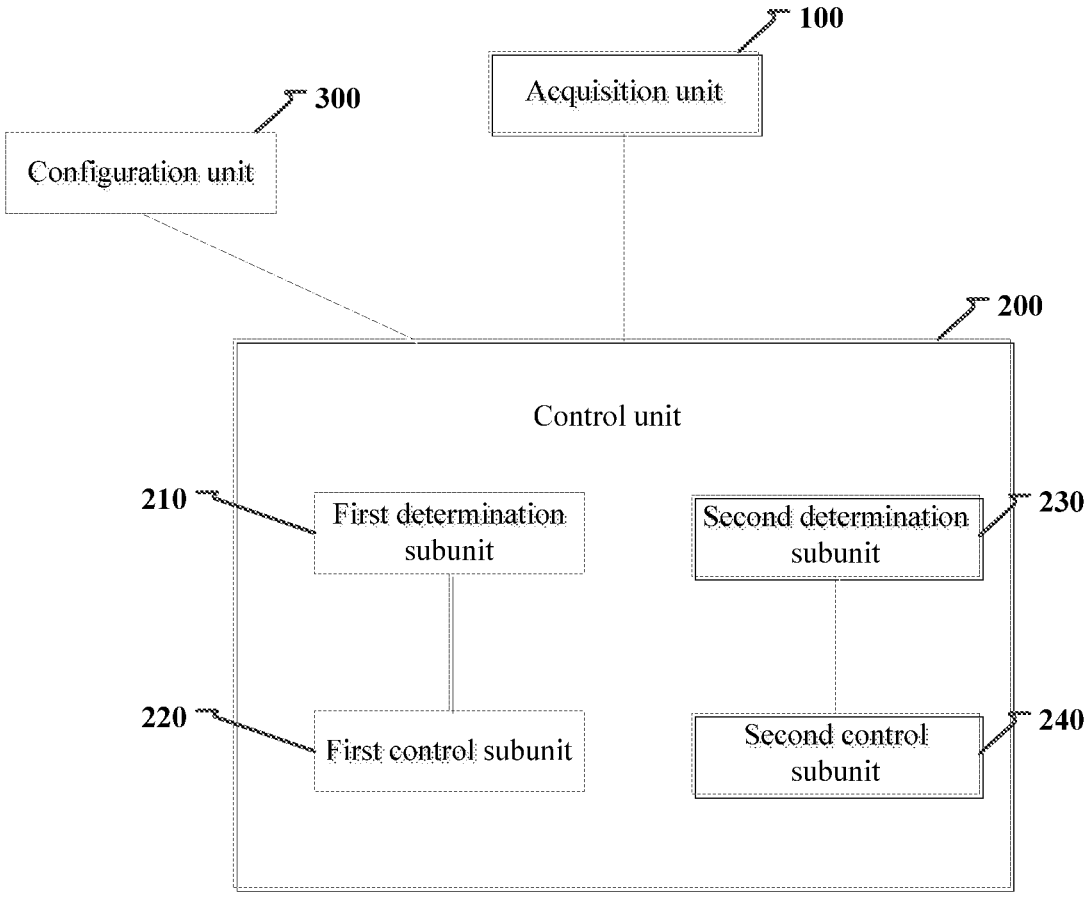
FIG. 5 is a block diagram of the apparatus for controlling an air conditioner according to an exemplary embodiment.

FIG. 5 is a block diagram of the apparatus for controlling an air conditioner according to an exemplary embodiment. As shown in FIG. 5, the apparatus may include: the acquisition unit 100 and the control unit 200, as well as the configuration unit 300. The control unit 200 may include: the first determination subunit 210 and the first control subunit 220, as well as the second determination subunit 230 and the second control subunit 240.

As such, the configuration unit 300 can configure each sleep control strategy, store corresponding relations of the range of physical characteristic parameters with the first physical characteristic coefficient and the second physical characteristic coefficient in each sleep control strategy, and store the corresponding relations of the range of energy consumption with the first energy consumption coefficient and the second energy consumption coefficient in each sleep control strategy; wherein the sleep control strategy includes the first sleep control strategy or the second sleep control strategy; within a certain physical characteristic range, an absolute value of the first physical characteristic coefficient in the first sleep control strategy is greater than an absolute value of the first physical characteristic coefficient in the second sleep control strategy; within a certain range of energy consumption, an absolute value of the first energy consumption coefficient in the first sleep control strategy is smaller than an absolute value of the first energy consumption coefficient in the second sleep control strategy; within a certain physical characteristic range, an absolute value of the second physical characteristic coefficient in the first sleep control strategy is smaller than an absolute value of the second physical characteristic coefficient in the second sleep control strategy; within a certain range of energy consumption, an absolute value of the second energy consumption coefficient in the first sleep control strategy is greater than an absolute value of the second energy consumption coefficient in the second sleep control strategy. For example, the configuration unit 300 configures the corresponding relationships as shown in Tables 1, 2, and 3.

When the air conditioner is subjected to the control, the acquisition unit 100 can acquire the current physical characteristic parameter of the air conditioner user in the current sampling timeframe, and when the current physical characteristic parameter falls within the set range of parameters in sleep, the control unit 200 can adjust either or both of the current setting temperature and the current compressor frequency of the air conditioner according to the current physical characteristic parameter and the current energy consumption of the air conditioner.

Herein, the first determination subunit 210 in the control unit 200 can determine the current first physical characteristic coefficient and the current first energy consumption coefficient in the selected current sleep control strategy corresponding to the current physical characteristic parameter and the current energy consumption, respectively; the first control subunit 220 may then determine and store the current set temperature of the air conditioner according to the current first physical characteristic coefficient, the current first energy consumption coefficient, and Equation (1), and control the air conditioner according to the current set temperature.

If the current physical characteristic parameter falls within the preset range of parameters and a duration longer than the set timeframe has elapsed, the second determination subunit 230 in the control unit 200 can determine the current second physical characteristic coefficient and the current second energy consumption coefficient in the selected current sleep control strategy corresponding to the current physical characteristic parameter and the current energy consumption. The second control subunit 240 may then determine and store the current compressor frequency of the air conditioner according to the current second physical characteristic coefficient, the current second energy consumption coefficient, and Equation (2), and control the air conditioner according to the current compressor frequency.

As can be seen, according to the embodiments of the invention, after the air conditioner user falls asleep, the air conditioner can be controlled according to the physical characteristic parameter of the user and the energy consumption of the air conditioner, that is, the physical characteristic of the user and the energy consumption are both considered, so that energy conservation and a comfortable user experience are compatible, thereby providing more functions for the control of the air conditioner in the sleep mode.

In an embodiment of the present invention, the apparatus for controlling the air conditioner is provided, and the apparatus is used for the air conditioner and includes:

a processor; and a memory for storing processor-executable instructions;

wherein the processor is configured for:

acquiring a current physical characteristic parameter of an air conditioner user in a current sampling timeframe; and adjusting either or both of a current set temperature and a current compressor frequency of the air conditioner according to the current physical characteristic parameter and a current energy consumption of the air conditioner when the current physical characteristic parameter falls within a set range of parameters in sleep.

The embodiments of the present invention provide a computer-readable storage medium having stored thereon computer instructions, wherein the instructions, when executed by a processor, perform the steps of the above method.

Those skilled in the art will appreciate that embodiments of the present invention may be provided as a method, system, or computer program product. Thus, the present invention may take the form of an entirely hardware embodiment, an entirely software embodiment, or an embodiment combining software and hardware aspects. Moreover, the present invention may take the form of a computer program product embodied on one or more computer-usable storage media having computer-usable program code therein, including but not limited to magnetic disk storage, optical storage, and the like.

The present invention is described with reference to a flowchart and/or a block diagram of a method, a device (system), and a computer program product according to embodiments of the present invention. It is to be understood that each flow and/or block of the flowchart and/or block diagram, and combinations of flows and/or blocks in the flowcharts and/or block diagrams, can be implemented through computer program instructions. These computer program instructions may be provided to a processor of a general-purpose computer, a special purpose computer, an embedded processor, or other programmable data processing devices to produce a machine, such that the instructions, which are executed by the processor of the computer or other programmable data processing devices, produce means for implementing the functions specified in one or more flows of the flowchart or and/or one or more blocks of the block diagram.

These computer program instructions may also be stored in a computer-readable memory that can direct a computer or other programmable data processing devices to function in a particular manner, such that the instructions stored in the computer-readable memory produce an article of manufacture including instruction means to implement the functions specified in one or more flows of the flowchart or and/or one or more blocks of the block diagram.

These computer program instructions may also be loaded onto a computer or other programmable data processing devices, causing a series of operational steps to be performed on the computer or other programmable devices to implement a computer-implemented process, so that the instructions executed on the computer or other programmable devices provide steps for implementing the functions specified in one or more flows of the flowchart or and/or one or more blocks of the block diagram.

It is to be understood that the invention is not limited to the processes and structures described above and shown in the drawings, and that various modifications and changes may be made without departing from the scope thereof. The scope of the invention is defined only by the appended claims.

What is claimed is:

1. A method for controlling an air conditioner, comprising:

acquiring a current physical characteristic parameter of an air conditioner user in a current sampling timeframe; and adjusting either or both of a current set temperature and a current compressor frequency of the air conditioner according to the current physical characteristic parameter and a current energy consumption of the air conditioner when the current physical characteristic parameter falls within a set range of parameters in sleep;

wherein the step of adjusting either or both of the current set temperature and the current compressor frequency of the air conditioner comprises:

determining a current first physical characteristic coefficient and a current first energy consumption coefficient which respectively correspond to the current physical characteristic parameter and the current energy consumption in a selected current sleep control strategy;

determining and storing the current set temperature of the air conditioner according to the current first physical characteristic coefficient, the current first energy consumption coefficient, and Equation (1), and controlling the air conditioner according to the current set temperature;

$$Tc=To-(at*U+ct*W) \quad (1)$$

where Tc is the current set temperature, To is a previous set temperature, U is the current physical characteristic parameter, W is the current energy consumption, and at and ct are the current first physical characteristic coefficient and the current first energy consumption coefficient, respectively.

2. A non-transitory computer-readable storage medium having stored thereon computer instructions, characterized in that the instructions, when executed by a processor, perform the steps of the method according to claim 1.

3. The method according to claim 1, wherein the step of adjusting either or both of the current set temperature and the current compressor frequency of the air conditioner comprises:

determining a current second physical characteristic coefficient and a current second energy consumption coefficient corresponding to the current physical characteristic parameter and the current energy consumption in the selected current sleep control strategy when the current physical characteristic parameter falls with a preset range of parameters and a duration longer than a set timeframe has elapsed, wherein the set range of parameters in sleep includes the preset range of parameters;

determining and storing the current compressor frequency of the air conditioner according to the current second physical characteristic coefficient, the current second energy consumption coefficient, and Equation (2), and controlling the air conditioner according to the current compressor frequency;

$$fc=fo-(ap*Up+cp*W) \quad (2)$$

wherein fc is the current set temperature, fo is the previous set temperature, U is the current physical characteristic parameter, W is the current energy consumption, and ap and cp are the current second physical characteristic coefficient and the current second energy consumption coefficient, respectively.

4. The method according to claim 3, further comprising:

configuring each sleep control strategy, storing corresponding relations of a range of physical characteristic parameters with the first physical characteristic coefficient and the second physical characteristic coefficient in each sleep control strategy; and storing the corresponding relations of a range of energy consumption with the first energy consumption coefficient and the second energy consumption coefficient in each sleep control strategy;

wherein the sleep control strategy includes a first sleep control strategy or a second sleep control strategy;

within a certain physical characteristic range, an absolute value of the first physical characteristic coefficient in the first sleep control strategy is greater than an absolute value of the first physical characteristic coefficient in the second sleep control strategy, an absolute value of the second physical characteristic coefficient in the first sleep control strategy is smaller than an absolute value of the second physical characteristic coefficient in the second sleep control strategy;

within a certain range of energy consumption, an absolute value of the first energy consumption coefficient in the first sleep control strategy is smaller than an absolute value of the first energy consumption coefficient in the second sleep control strategy, an absolute value of the second energy consumption coefficient in the first sleep control strategy is greater than an absolute value of the second energy consumption coefficient in the second sleep control strategy.

5. A non-transitory computer-readable storage medium having stored thereon computer instructions, characterized in that the instructions, when executed by a processor, perform the steps of the method according to claim 4.

6. A non-transitory computer-readable storage medium having stored thereon computer instructions, characterized in that the instructions, when executed by a processor, perform the steps of the method according to claim 3.

7. A method for controlling an air conditioner, comprising:

acquiring a current physical characteristic parameter of an air conditioner user in a current sampling timeframe; and adjusting either or both of a current set temperature and a current compressor frequency of the air conditioner according to the current physical characteristic parameter and a current energy consumption of the air conditioner when the current physical characteristic parameter falls within a set range of parameters in sleep;

wherein the step of adjusting either or both of the current set temperature and the current compressor frequency of the air conditioner comprises:

determining a current first physical characteristic coefficient and a current first energy consumption coefficient corresponding to the current physical characteristic parameter and the current energy consumption in a selected current sleep control strategy when the current physical characteristic parameter falls with a preset range of parameters and a duration longer than a set timeframe has elapsed, wherein the set range of parameters in sleep includes the preset range of parameters;

determining and storing the current compressor frequency of the air conditioner according to the current first physical characteristic coefficient, the current first energy consumption coefficient, and Equation (2), and controlling the air conditioner according to the current compressor frequency;

$$fc=fo-(ap*Up+cp*W) \quad (2)$$

wherein fc is the current set temperature, fo is the previous set temperature, U is the current physical characteristic parameter, W is the current energy consumption, and ap and cp are the current first physical characteristic coefficient and the current first energy consumption coefficient, respectively.

8. A non-transitory computer-readable storage medium having stored thereon computer instructions, characterized in that the instructions, when executed by a processor, perform the steps of the method according to claim 7.

9. An apparatus for controlling the air conditioner, comprising:

an acquisition unit configured to acquire a current physical characteristic parameter of an air conditioner user in a current sampling timeframe; and a control unit configured to adjust either or both of a current set temperature and a current compressor frequency of the air conditioner according to the current physical characteristic parameter and a current energy consumption of the air conditioner when the current physical characteristic parameter falls within a set range of parameters in sleep;

wherein the control unit comprises:

a first determination subunit configured to determine a current first physical characteristic coefficient and a current first energy consumption coefficient which respectively correspond to the current physical characteristic parameter and the current energy consumption in a selected current sleep control strategy;

a first control subunit configured to determine and store the current set temperature of the air conditioner according to the current first physical characteristic coefficient, the current first energy consumption coefficient, and Equation (1), and control the air conditioner according to the current set temperature;

$$Tc=To-(at*U+ct*W) \quad (1)$$

where Tc is the current set temperature, To is a previous set temperature, U is the current physical characteristic parameter, W is the current energy consumption, and at and ct are the current first physical characteristic coefficient and the current first energy consumption coefficient, respectively.

10. The apparatus according to claim 9, wherein the control unit comprises:

a second determination subunit configured to determine a current second physical characteristic coefficient and a current second energy consumption coefficient corresponding to the current physical characteristic parameter and the current energy consumption in the selected current sleep control strategy when the current physical characteristic parameter falls with a preset range of parameters and a duration longer than a set timeframe has elapsed, wherein the set range of parameters in sleep includes the preset range of parameters;

determine and store the current compressor frequency of the air conditioner according to the current second physical characteristic coefficient, the current second energy consumption coefficient, and Equation (2), and control the air conditioner according to the current compressor frequency;

$$fc=fo-(ap*Up+cp*W) \quad (2)$$

wherein fc is the current set temperature, fo is the previous set temperature, U is the current physical characteristic parameter, W is the current energy consumption, and ap and cp are the current second physical characteristic coefficient and the current second energy consumption coefficient, respectively.

11. The apparatus according to claim 10, further comprising:

a configuration unit to configure each sleep control strategy, store corresponding relations of a range of physical characteristic parameters with the first physical characteristic coefficient and the second physical characteristic coefficient in each sleep control strategy, and store the corresponding relations of a range of energy consumption with the first energy consumption coefficient and the second energy consumption coefficient in each sleep control strategy;

wherein the sleep control strategy includes a first sleep control strategy or a second sleep control strategy;

within a certain physical characteristic range, an absolute value of the first physical characteristic coefficient in the first sleep control strategy is greater than an absolute value of the first physical characteristic coefficient in the second sleep control strategy, an absolute value of the second physical characteristic coefficient in the first sleep control strategy is smaller than an absolute value of the second physical characteristic coefficient in the second sleep control strategy;

within a certain range of energy consumption, an absolute value of the first energy consumption coefficient in the first sleep control strategy is smaller than an absolute value of the first energy consumption coefficient in the second sleep control strategy, an absolute value of the second energy consumption coefficient in the first sleep control strategy is greater than an absolute value of the second energy consumption coefficient in the second sleep control strategy.

12. An apparatus for controlling the air conditioner, comprising:

an acquisition unit configured to acquire a current physical characteristic parameter of an air conditioner user in a current sampling timeframe; and a control unit configured to adjust either or both of a current set temperature and a current compressor frequency of the air conditioner according to the current physical characteristic parameter and a current energy consumption of the air conditioner when the current physical characteristic parameter falls within a set range of parameters in sleep;

wherein the control unit comprises:

a first determination subunit configured to determine a current first physical characteristic coefficient and a current first energy consumption coefficient corresponding to the current physical characteristic parameter and the current energy consumption in a selected current sleep control strategy when the current physical characteristic parameter falls with a preset range of parameters and a duration longer than a set timeframe has elapsed, wherein the set range of parameters in sleep includes the preset range of parameters;

determine and store the current compressor frequency of the air conditioner according to the current first physical characteristic coefficient, the current first energy consumption coefficient, and Equation (2), and control the air conditioner according to the current compressor frequency;

$$fc=fo-(ap*Up+cp*W) \quad (2)$$

wherein fc is the current set temperature, fo is the previous set temperature, U is the current physical characteristic parameter, W is the current energy consumption, and ap and cp are the current first physical characteristic coefficient and the current first energy consumption coefficient, respectively.

13. An apparatus for controlling the air conditioner, the apparatus being used for an air conditioner, and comprising:

a processor;

a memory for storing processor-executable instructions;

wherein the processor is configured for:

acquiring a current physical characteristic parameter of an air conditioner user in a current sampling timeframe; and adjusting either or both of a current set temperature and a current compressor frequency of the air conditioner according to the current physical characteristic parameter and a current energy consumption of the air conditioner when the current physical characteristic parameter falls within a set range of parameters in sleep;

wherein the step of adjusting either or both of the current set temperature and the current compressor frequency of the air conditioner comprises:

determining a current first physical characteristic coefficient and a current first energy consumption coefficient which respectively correspond to the current physical characteristic parameter and the current energy consumption in a selected current sleep control strategy;

determining and storing the current set temperature of the air conditioner according to the current first physical characteristic coefficient, the current first energy consumption coefficient, and Equation (1), and controlling the air conditioner according to the current set temperature;

$$Tc=To-(at*U+ct*W) \quad (1)$$

where Tc is the current set temperature, To is a previous set temperature, U is the current physical characteristic parameter, W is the current energy consumption, and at and ct are the current first physical characteristic coefficient and the current first energy consumption coefficient, respectively.

14. The apparatus according to claim 13, wherein the step of adjusting either or both of the current set temperature and the current compressor frequency of the air conditioner comprises:

determining a current second physical characteristic coefficient and a current second energy consumption coefficient corresponding to the current physical characteristic parameter and the current energy consumption in the selected current sleep control strategy when the current physical characteristic parameter falls with a preset range of parameters and a duration longer than a set timeframe has elapsed, wherein the set range of parameters in sleep includes the preset range of parameters;

determining and storing the current compressor frequency of the air conditioner according to the current second physical characteristic coefficient, the current second energy consumption coefficient, and Equation (2), and controlling the air conditioner according to the current compressor frequency;

$$fc=fo-(ap*Up+cp*W) \quad (2)$$

wherein fc is the current set temperature, fo is the previous set temperature, U is the current physical characteristic parameter, W is the current energy consumption, and ap and cp are the current second physical characteristic coefficient and the current second energy consumption coefficient, respectively.

15. The apparatus according to claim 14, wherein the processor is further configured for:

configuring each sleep control strategy, storing corresponding relations of a range of physical characteristic parameters with the first physical characteristic coefficient and the second physical characteristic coefficient in each sleep control strategy; and storing the corresponding relations of a range of energy consumption with the first energy consumption coefficient and the second energy consumption coefficient in each sleep control strategy;

wherein the sleep control strategy includes a first sleep control strategy or a second sleep control strategy;

within a certain physical characteristic range, an absolute value of the first physical characteristic coefficient in the first sleep control strategy is greater than an absolute value of the first physical characteristic coefficient in the second sleep control strategy, an absolute value of the second physical characteristic coefficient in the first sleep control strategy is smaller than an absolute value of the second physical characteristic coefficient in the second sleep control strategy;

within a certain range of energy consumption, an absolute value of the first energy consumption coefficient in the first sleep control strategy is smaller than an absolute value of the first energy consumption coefficient in the second sleep control strategy, an absolute value of the second energy consumption coefficient in the first sleep control strategy is greater than an absolute value of the second energy consumption coefficient in the second sleep control strategy.

16. An apparatus for controlling the air conditioner, the apparatus being used for an air conditioner, and comprising:

a processor;

a memory for storing processor-executable instructions;

wherein the processor is configured for:

acquiring a current physical characteristic parameter of an air conditioner user in a current sampling timeframe; and adjusting either or both of a current set temperature and a current compressor frequency of the air conditioner according to the current physical characteristic parameter and current energy consumption of the air conditioner when the current physical characteristic parameter falls within a set range of parameters in sleep;

wherein the step of adjusting either or both of the current set temperature and the current compressor frequency of the air conditioner comprises:

determining a current first physical characteristic coefficient and a current first energy consumption coefficient corresponding to the current physical characteristic parameter and the current energy consumption in a selected current sleep control strategy when the current physical characteristic parameter falls with a preset range of parameters and a duration longer than a set timeframe has elapsed, wherein the set range of parameters in sleep includes the preset range of parameters;

determining and storing the current compressor frequency of the air conditioner according to the current first physical characteristic coefficient, the current first energy consumption coefficient, and Equation (2), and controlling the air conditioner according to the current compressor frequency;

$$fc=fo-(ap*Up+cp*W) \quad (2)$$

wherein fc is the current set temperature, fo is the previous set temperature, U is the current physical characteristic parameter, W is the current energy consumption, and ap and cp are the current first physical characteristic coefficient and the current first energy consumption coefficient, respectively.

* * * * *